United States Patent [19]

Schindler

[11] Patent Number: 4,905,484

[45] Date of Patent: Mar. 6, 1990

[54] MULTISYSTEM CIRCULAR KNITTING MACHINE HAVING ELECTROMAGNETIC NEEDLE SELECTION

[75] Inventor: Hartmut Schindler, Albstadt 2-Tailfingen, Fed. Rep. of Germany

[73] Assignee: Sipra Patententwicklungs-und Beteiligungsgesellschaft mbH, Albstadt 2-Tailfingen, Fed. Rep. of Germany

[21] Appl. No.: 179,385

[22] Filed: Apr. 8, 1988

[30] Foreign Application Priority Data

Apr. 14, 1987 [DE] Fed. Rep. of Germany ..... 3712673

[51] Int. Cl.[4] ..... D04B 15/78

[52] U.S. Cl. ..... 66/220; 66/115

[58] Field of Search ..... 66/75.2, 8, 115, 219, 66/220

[56] References Cited

U.S. PATENT DOCUMENTS

| | | | |
|---|---|---|---|
| 3,283,541 | 11/1966 | De Cerjat | 66/220 |
| 3,961,501 | 6/1976 | Martinetz | 66/222 X |
| 4,038,837 | 8/1977 | Guell | 66/222 X |
| 4,770,009 | 9/1988 | Mozer | 66/75.2 X |

FOREIGN PATENT DOCUMENTS

| | | | |
|---|---|---|---|
| 1116744 | 6/1968 | United Kingdom | 66/220 |
| 2061327 | 5/1981 | United Kingdom | 66/75.2 |

*Primary Examiner*—Wm. Carter Reynolds
*Attorney, Agent, or Firm*—Michael J. Striker

[57] ABSTRACT

In a multiple system circular knitting machine having an electromagnetic needle selection, the needle and jack cam races are supported on a stationary support ring which rests on a plurality of radially directed and mutually spaced ribs. To improve operational reliability and maintenance of needle selection devices, each selection electromagnet is mounted at an end portion of an elongated holder and is situated in a circumferential recess in the needle cylinder opposite end portions of respective selecting jacks. The magnet holders are adjustably secured to the lower surface of the support ring. The needle selecting cams include a pair of circumferentially staggered and axially superposed pressing cams of which the leading lower pressing cam first engages the lower end portion of the selecting jack and moves the same radially inwardly to a point where the upper pressing cam takes over and presses an armature surface of the end portion of the jack against an electromagnet. In this manner, the negative effect of wear of selecting cams is neutralized.

10 Claims, 6 Drawing Sheets

MULTISYSTEM CIRCULAR KNITTING MACHINE HAVING ELECTROMAGNETIC NEEDLE SELECTION

BACKGROUND OF THE INVENTION

The present invention relates to a multiple system circular knitting machine having electromagnetic needle selection means whereby the longitudinally shiftable and radially tiltable selecting plate bars or jacks are tilted by a push cam member against the force of a resetting spring to be forwarded in the range of a selection electromagnet at each selection point of the machine.

In circular knitting machines having electromagnetic needle selection there occurred problems as regards the reliability of functioning of the needle selection means when rotary speed of the machine has been increased. In particular, the abrasion of selecting jacks and of selecting cam parts has been found as the source of interferences during the operation of the machine.

SUMMARY OF THE INVENTION

It is therefore a general object of this invention to overcome the disadvantage of prior art knitting machines of this kind and to provide a circular knitting machine having electromagnetic selection wherein the wear phenomena on selecting jacks which might affect the functionability of the electromagnetic needle selection means, are diminished and their negative effect is reduced.

In keeping with this object and others which will become apparent hereafter, one feature of this invention resides in the provision of a common supporting ring surrounding the needle cylinder and supporting the superposed jack cams and needle cams of all knitting systems, the support ring resting on a plurality of radial ribs mounted on a supporting plate secured to the machine frame, each of the selecting electromagnets being mounted on an end portion of an elongated holder which is insertable into the spacing between two radial ribs such that the electromagnet enters a circumferential recess in the needle cylinder opposite the path of movement of end portions of the selecting jacks, the magnet holders being disconnectably secured to the support ring and adjusted in a position at which the assigned electromagnet is located at the corresponding selection point, and the jack cams including for each selection point a pair of axially superposed and circumferentially offset pressure cams which during the rotation of the needle cylinder swing the end portions of the selecting jacks in the working range of respective electromagnets at the selection points.

In a preferred embodiment, the lower one of the pressing cams engages the end portion of the selecting jack first and moves the same radially inwardly at a relatively slow rate to a transfer point before the selection point, and the upper pressing cam taking over the end portion of the selecting jack at the transfer point and moving the end portion at a higher rate in contact with the electromagnet at the selection point.

The construction of the circular knitting machine according to the invention has the advantage that the selecting electromagnet can be inserted, exchanged and most importantly readjusted in position at the selection point without the necessity to remove the corresponding system cam races. One of the two pressure cams executes the major part on the swinging movement of the selecting jacks in the direction against the selecting magnets. The second pressure cam whose position in the cam race preferably is finely adjustable, executes the accurate position adjustment of the end portion of the selecting jack relative to the selecting magnet whereby with advantage it presses the jacks with a slight overpressure against the magnets to such an extent that a slight elastic bending of the end portion of the jack between its fulcrum engaging the bottom of the guiding slot in the needle cylinder and the point of engagement of the jack on the electromagnet will occur. With advantage, the first pressure cam acts on the straight end surface portion of the stem of the selecting jack whereby the opposite surface portion acts as the armature for the magnet. At the same time, each selecting jack which acts as a needle pusher is free to perform without obstacles its movement in longitudinal or axial direction during the swinging movement enforced by the first pressure cam. The second pressure cam acts preferably on a run-on surface of a lift butt formed on the selecting jack at a distance from its lower end portion whereby it also can exert a slight overpressure to cause a certain amount of elastic bowing of the selecting jack.

The area of the selecting jack which is subject to the greatest wear is the surface region of the stem engaging the first pressure cam. In contrast, only a minute wear occurs on the run-on surface of the lift butt of the jacks and on the second cam acting on the lift butts, that means the parts which finely determine the abutment point of the selecting jack on the magnet remain substantially without wear.

With advantage, the region of the needle cylinder at the level of the first pressure cams is provided with a recess in the outer side of the guiding slots in which the first pressure cam can enter. In this manner it is achieved that in this region the butts of the selecting jacks are subject to no load, the selecting jacks are prevented from tilting against lateral walls of the guiding slots and are fully guided by the latter. When the lift butt of the jack contacts the second pressure cam, it has been already partially immersed in the recess between the guiding slots. Accordingly, even with finely divided spacings and with thin guiding webs for the jacks there is no danger of lateral bending of the selecting jacks. Moreover, by virtue of the construction of the two pressure cams installation space is saved in the circumferential area of the systems inasmuch as the radial tilting and the longitudinal shifting of the selecting jacks can partially overlap.

The operational reliability of the needle selection in the circular knitting machine constructed according to the invention can be further increased by providing the circumferential recess in the needle cylinder with a lining or annular jacket of a magnetically nonconductive material which separates the selecting electromagnets at respective selection points from the cylinder. In this manner any magnetic short circuits via the needle cylinder are avoided and the total magnetic energy at the magnet poles is available for acting on the selecting jacks.

The novel arrangement of selection magnets according to the invention makes it also possible to compensate dimensional changes resulting due to the unavoidable heating up of the machine during its operation in the range of the functionally important and adjusted needle selection locations. For this purpose, the magnet holders which according to the invention are constructed in the form of elongated bars fastened to the lower side of the common support ring by means of a tilt adjusting plate and by radial position adjusting screws. The inner end of the holder projecting into the recess in the needle cylinder is made of a magnetically non-conductive material upon which the selection magnet is seated. The selection magnet has pole pieces of soft iron which are directed radially outwardly toward the path of movement of the selecting jacks. The thermal expansion of the holding bar which is secured to the support ring is directed radially inwardly whereas the thermal expansion of the pole pieces of the soft iron is directed in opposite direction that means radially outwardly and consequently practically neutralizes the thermal expansion of the holder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a front view in the direction of arrow II of a sectional plane of the machine of FIG. 1 showing on an enlarged scale the cam components of two adjacent systems of the machine each having its own needle selection point.

FIG. 4A shows a partial view of the selecting jack;

DESCRIPTION OF THE PREFERRED EMBODIMENTS

Figure 1:
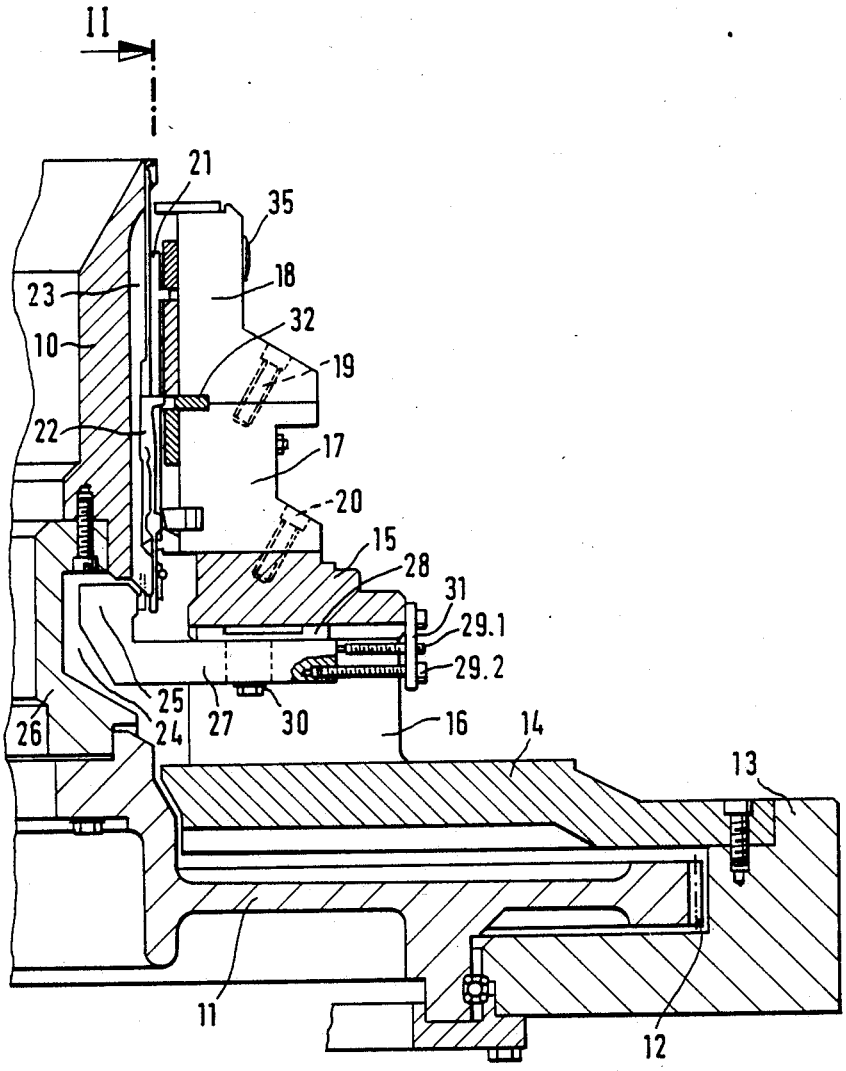
FIG. 1 shows a radial section of a cutaway part of the needle cylinder, the cam races with supporting parts thereof on a circular knitting machine in the area of a needle selection point.

FIG. 1 illustrates in a radial section the part of a circular knitting machine which includes a needle cylinder 10 bolted to a cylinder support gearing 11 which on its circumference is provided with outer toothed drive gear 12. A stationary cam race support plate 14 is bolted to machine frame 13 and is provided on its upper surface with a plurality of radially directed and uniformly distributed ribs 16 upon which a common support ring 15 is mounted. A jack cam race 17 which includes all cam components for each of the systems of the knitting machine is fastened on the support ring 15 and a needle cam race 18 is fastened on top of the underlying jack cam race 17. In this embodiment, the cam races 17 and 18 can be individually disassembled and removed by releasing the fastening screws 19 and 20. In a modification, both races can be integrated in a single construction unit.

The needle cylinder 10 is provided on its circumference with a plurality of axially directed slots in which webs 23 are inserted to guide needles 21 and the corresponding selecting jacks 22 which act from below on the ends of the needles. A needle in conjunction with a selecting jack is illustrated on an enlarged scale on FIG. 2. The guiding slots of the needle cylinder terminate at the level of the support ring 15 and below this level a circumferential recess 24 is formed in the lower cylinder portion which communicates with free spaces between the radially directed ribs 16 on the supporting plate 14. Selecting magnets 25 are inserted through the spacings between the ribs into the annular recess 24 and their location coincides with the selection points of respective systems of the knitting machine. The inner wall of the recess 24 is provided with an annular jacket 26 of magnetically non-conducting material which separates the magnets 25 from the needle cylinder 10 and its gear ring 11 and prevents a magnetic short circuit of the magnetic field through the needle cylinder. Each selecting magnet 25 is arranged on an end portion of a bar shaped holder 27 which is fastened via an adjustment plate 28 to the lower side of the stationary support ring 15 and adjusted in its radial position and its tilted position relative to the adjustment plate 28 by setting screws 29.1 and 29.2 and fixed in the adjusted positions by a clamping screw 30. The two setting screws 29.1 and 29.2 are supported in mounting plate 31 which is fixed to the outer wall of the support ring 15.

Figures 2A, 2B:
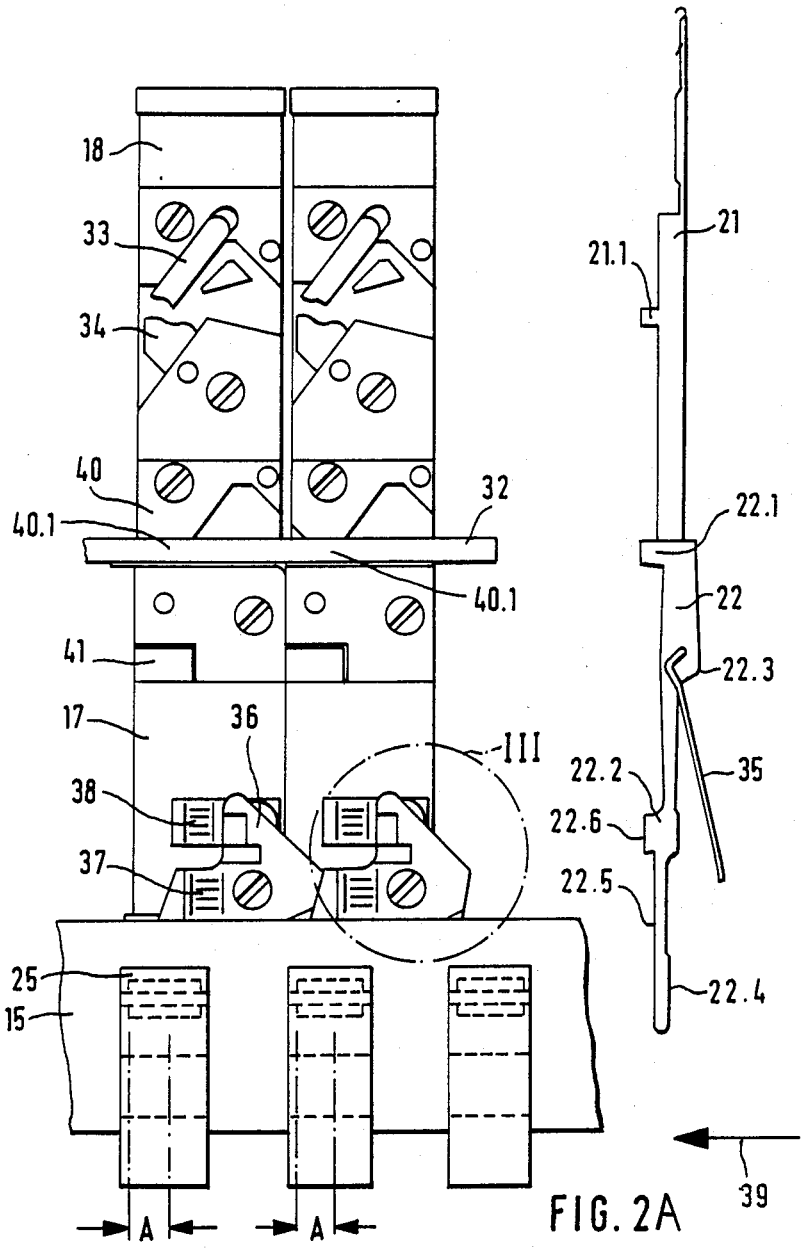
FIG. 2*a* shows a needle in conjunction with a selecting jack.

FIG. 2 illustrates cam components of the jack cam race 17 and needle cam race 18 pertaining to two adjacent systems of the knitting machine. In an annular groove in the jack cam race 17 is arranged a safety ring 32 for the jacks which prevents during the removal of the jack cam race 17 the selecting jacks 22 from falling out of their guiding slots in the needle cylinder 10. The superposed needle cams include a conventional sinker cam component 33 with a counter cam 34 which are jointly adjustable by means of an adjusting disk 35 illustrated in FIG. 1. The needle cam components act on a butt 21.1 of the needles 21. The selecting jack 22 which acts as a needle pusher is provided with a head butt 22.1, a lift butt 22.2, a fulcrum 22.3 and a resetting spring 35. The lower end of the stem of the selecting jack 22 is formed on its inwardly directed side with an armature surface 22.4 and the opposite stem side is formed with a straight run-on surface 22.5. This configuration of the selecting jack 22 permits simultaneously a longitudinal displacement and a tilting displacement in its guiding slot. On the front or outer side of the lift butt 22.2 a second run-on surface 22.6 is formed.

The jack cam race 17 includes lift cam components 36 for engaging the lift butt 22.2 and two circumferentially offset press cam components, namely a first press cam component 37 and a second press cam component 38 whose operation will be explained later in connection with FIGS. 3 to 8. The two press ca components 37 and 38 are situated before the selecting range A of each selecting magnet 25 when viewed in the direction of circulation of the selecting jacks, the selection regions coinciding with the selection points assigned to respective systems of the knitting machine. The additional cam components 40 and 41 serve for engaging the head butts 21.2 and for detaining the jacks in the range of their fulcrums 22.3. The cams 40 clear the way for the raising movement of the jacks 22 and guide their head butts downward into the circulation channel 40.1. The needle selection at the needle selection points takes place when the head butts are at the level of the circulation channel 40.1. The cam 41 does not act as a press cam component and a certain play is always present between the cam 41 and the stem of the selecting jack 22.

Figure 3:
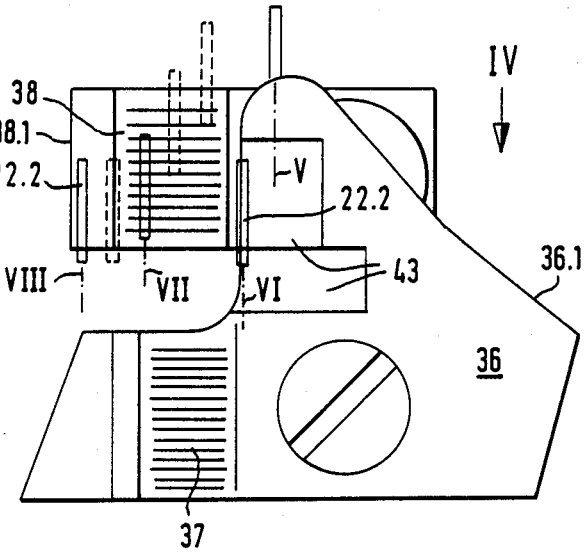
FIG. 3 shows on an enlarged scale the detail III in FIG. 2.
Figure 4:
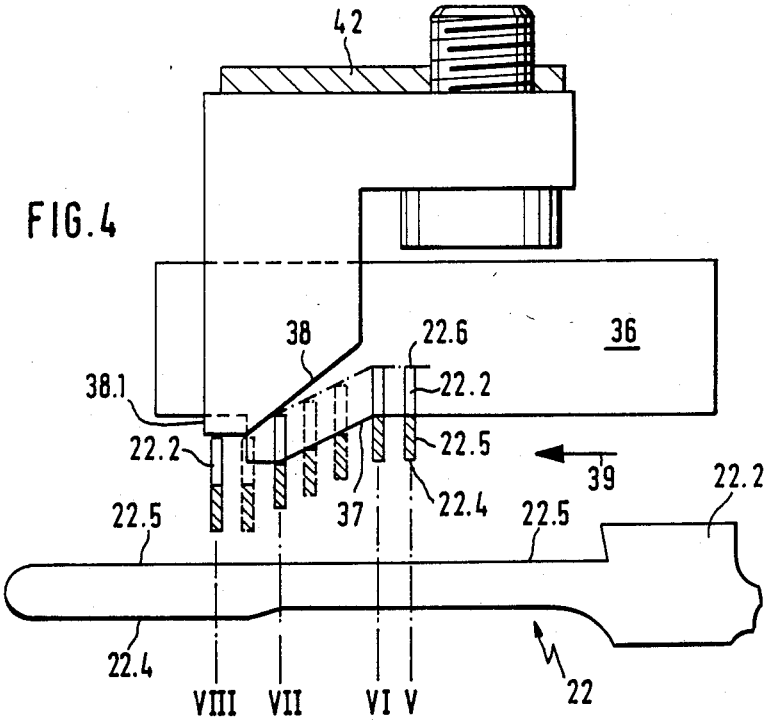
FIG. 4 is a plan view a jack lifting cam of FIG. 3 when viewed in the direction of arrow IV.

Enlarged illustrations in FIGS. 3 and 4 show a jack lifting cam 36 together with its lifting edge 36.1 for engaging the lift butt 22.2 whose various positions in the range of the first pressure cam 37 and the second pressure cam 38 are indicated for different phases of circulation of the jacks. Four of the circulation phases are indicated by reference numerals V, VI, VII and VIII. In addition, FIG. 4 also shows the lower end portion of a selecting jack 22. It will be seen from FIG. 4 that the selecting jacks 22 in the course of their circulation in the direction of arrow 39 first engage with their run-on surface 22.5 the first pressure cam component 37 which raises at relatively small angle and which moves the selecting jack 22 radially inwardly at a relatively slow rate until the jack 22 is tilted inwardly up to the position VII which is a transfer point and where the lift butt 22.2 engages with its run-on surface 22.6 the second pressure cam component 38. The position of the cam 38 is accurately adjustable by an intermediate piece 42. The pressure cam component 38 moves the selecting jack 22 from the transfer point (position VII) at a higher rate until its armature surface 22.4 abuts against a selecting magnet 25. The second pressure cam component 38 terminates in the direction of circulation with a discharge edge 38.1 which allows the spring 35 to swing back the jack 22 after its release from the magnet 25. FIG. 3 indicates also recess 43 in the lift cam 36 for receiving lift butts 22.2 of those jacks which proceed in the circumferential direction that is which don't engage the lift edge 36.1, thereby allowing an early engagement of their stems with the first pressure cam component 37.

Figure 5:
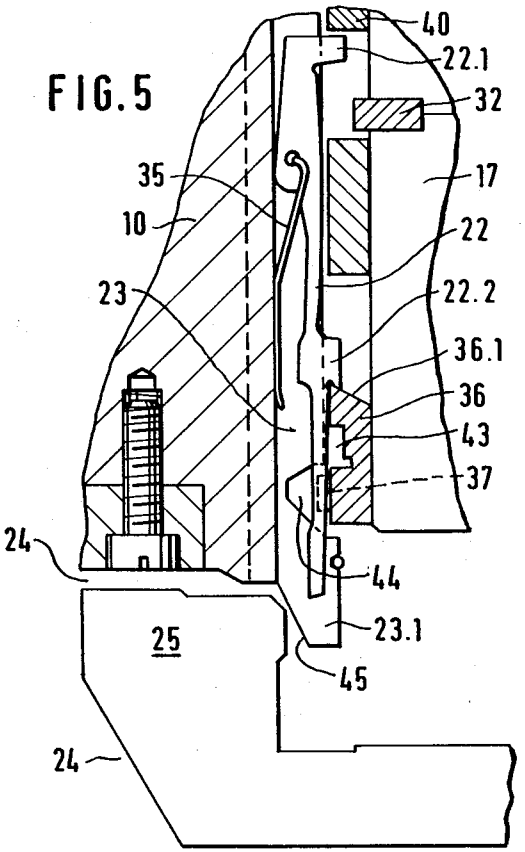

FIG. 5 shows an entire selecting jack 22 in its position V indicated in FIGS. 3 and 4. The jack has been selected at a preceding needle selection point to engage with its lift butts 22.2 the lift edge 36.1 of cam component 36 which lifts the jack and hence the superposed needle 21 in its knitting position. The lower end portion of the jack is situated shortly before the run-on surface of the first pressure cam component 37. It will be seen from FIGS. 5 through 8 that the guiding slots or webs 23 at the level of the first pressure cam component 37 are formed with a recess 44 into which the first pressure cam 37 can enter. The lower end portion 23.1 of the guiding webs 23 overlaps the edge of the recess 24 in the needle cylinder to guide the lower end portions of the jacks passed the electromagnets 25. Inner sides 45 of the projecting portions 23.1 of the guiding webs are beveled so as to prevent interference with the pole pieces of the magnets 25.

Figure 6:
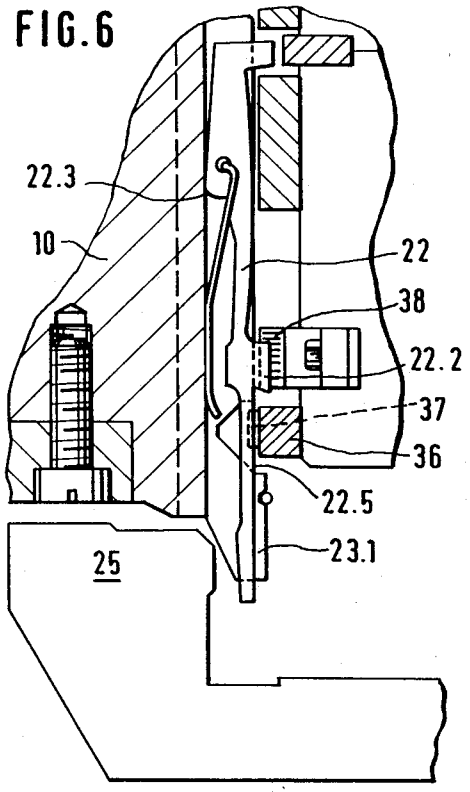
FIGS. 5 through 8 show respectively on an enlarged scale positions of a selecting jack of a system pertaining to a needle selection point at circumferential positions V through VIII indicated in FIG. 3.

FIG. 6 shows the selecting jack 22 in its circulation position VI in FIGS. 3 and 4. In this position, the lift butt 22.2 has exited the recess 43 in the lift cam 36 and its run-on surface 22.5 starts engaging the first pressure cam component 37.

Figure 7:
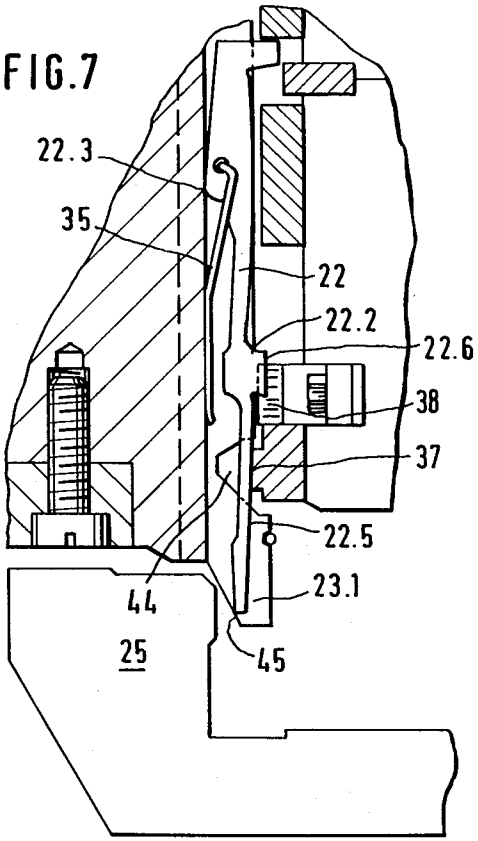

FIG. 7 illustrates the selecting jack 22 in the position VII according to FIGS. 3 and 4. Its first run-on surface 22.5 has already raised a certain distance on the first pressure cam component 37 and accordingly, the jack has been tilted about its fulcrum 22.3 and has reached a point where the second run-o surface 22.6 on the lift butt 22.2 starts engaging the second pressure cam component 38. The peak point on the first pressure cam component 37 has been already reached and the tilting movement of the selecting jack 22 is taken over by the second pressure cam component 38 acting on the lift butt 22.2.

Figure 8:
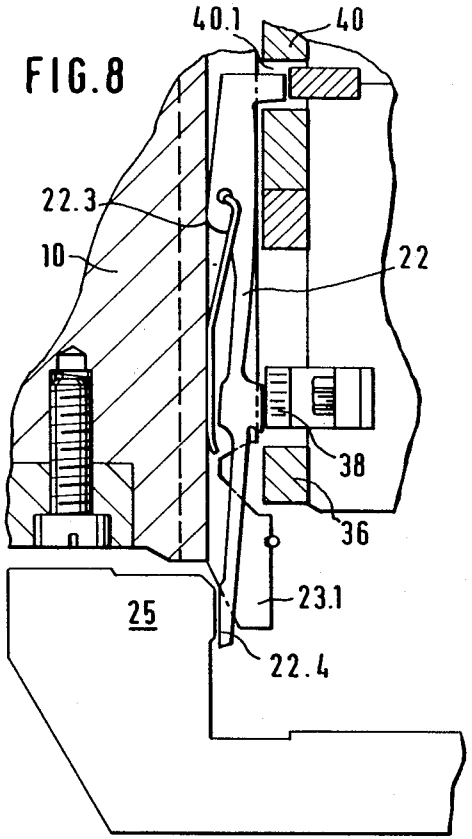

FIG. 8 shows the jack 22 in its position VIII of FIGS. 3 and 4. The lift butt 22.2 has reached the highest point on the second pressure cam component 38. At this maximum swing out position the armature surface 22.4 at the lower end of the jack is pressed against the corresponding selection magnet 25 whereby preferably a light overpressure is exerted by the cam so as to introduce a slight bowing or arching of the jack stem portion between the fulcrum 22.3 and the contact point of the armature surface 22.4 with the magnet, thus neutralizing manufacturing tolerances and wear. Then the jack 22 is discharged from engagement with the second pressure cam component 38 along the discharge edge 38.1 of the second pressure cam component 38 (FIG. 4) and the jack is either retained in this position by the electromagnet 25 to proceed to the next system of the machine in the circulating direction, or is released by the electromagnet and consequently the return spring 35 tilts the jack in a position in which in the following system its lift butt 22.2 is brought into engagement with lift cam 36.

Figure 9:
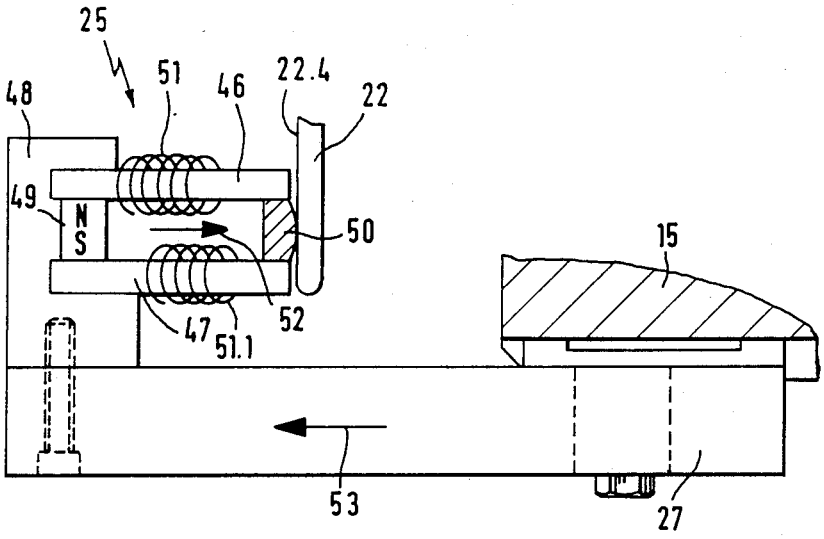
FIG. 9 is a schematic side view of a selecting electromagnet together with its holder, shown on an enlarged scale.

FIG. 9 shows the construction of the selection magnets 25. Each selection magnet is designed in conventional manner and includes two superposed pole pieces 46 and 47 of soft iron which at one end thereof are in contact with an interposed permanent magnet 419 and anchored in a support block 48 of a magnetically non-conducting material. The opposite free ends of the pole pieces are connected to an interposed slide strip 50 of saphire having a raised slide face against which the armature surface 22.4 of the selecting jacks 22 is pressed. Each of the pole pieces 46 and 47 is provided with a releasing winding 51 or 51.1 supplied by current pulses which neutralize the pulling force of the permanent magnet and by a magnetic field pole reversal release the end portions of the selecting jacks 22. The magnetically non-conductive support block 48 is screwed to an end portion of a web or bar-shaped magnet holder 27 whose opposite end is adjustably secured to the support ring 15 as it has been described in connection with FIG. 1. Both the magnet holder 27 and the pole pieces 46, 47 have their free ends oriented in opposite radial directions. Accordingly, after heating the machine the longitudinal expansion of the magnet holders 27 occurs in the direction of arrow 53 and this expansion is neutralized by the opposite expansion movement of the soft iron pole pieces in the direction of arrow 52. As a consequence, the adjusted position of the selection magnets 25 relative to the circulation path of the selecting jacks 22 is held constant. In addition, the construction of the knitting machine according to this invention permits a readjustment of the position of the selecting magnets 25 or the exchange of individual magnets without the necessity of dismantling the supports of cams of the corresponding system.

While the invention has been illustrated and described as embodied in a specific example of a circular knitting machine, it is not intended to be limited to the details shown, since various modifications and structural changes ma be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A multisystem circular knitting machine comprising a needle cylinder supported for rotation about a central axis and having axially oriented guiding slots in its jacket, each of said slots guiding a needle and a selecting jack arranged below the needle, each selecting jack having fulcrum portion for imparting a swinging movement thereto and a resetting spring, a cam race assembly surrounding said needle cylinder and including a stationary supporting plate secured to a machine frame, a plurality of radially directed ribs mounted on said supporting plate, a supporting ring mounted on said ribs, a jack cam race mounted on said supporting ring and a needle cam race mounted on said jack cam race, a lower part of said needle cylinder opposite said support ring and said radially directed ring being formed with a circumferential recess communicating with free spacings between said ribs, lower end portions of said selecting jacks each being provided with an armature surface overlapping said guiding slots, electromagnetic needle selection means including a plurality of electromagnets arranged at predetermined selection points in said circumferential recess, each of said electromagnets being mounted at one end of a bar-shaped support member inserted into a spacing between said radial ribs and being adjustably secured to a lower side of said supporting ring, and said jack cam race including pairs of circumferentially offset and axially superposed pressing cams assigned to respective systems of the machine to engage said end portions of said selecting jacks and to move their armature surfaces against said electromagnets at respective selection points, the lower one of said pressing cams engaging said end portion of the selecting jack first and moving the same radially inwardly at a relatively slow rate of a transfer point before said selection point, and the upper pressing cam taking over said end portion of the selecting jack at said transfer point and moving said end portion at a higher rate in contact with said electromagnet at said selection point.

2. A circular knitting machine as defined in claim 1 wherein each of said selecting jacks is provided with a lift butt for engaging system cams in said jack ram race, said lift butts each having a run-on portion for engaging said upper pressing cam, and said lower end portion of the selecting jack being formed with a run-on surface for engaging said lower pressing cam and an opposite armature surface for engaging said electromagnets.

3. A circular knitting machine as defined in claim 2 wherein said upper pressing cam after bringing said armature surface portion of the selecting jack in contact with said electromagnet applies a slight overpressure on said run-on portion to elastically bend said selecting jack between its fulcrum resting in a guiding slot on the needle cylinder and its armature surface contacting said electromagnet.

4. A circular knitting machine as defined in claim 3 wherein said circumferential recess in said needle cylinder for accommodating said electromagnets is provided on its wall with an annular jacket of a magnetically nonconductive material to prevent magnetic short circuit between said electromagnet and said needle cylinder.

5. A circular knitting machine as defined in claim 4 further comprising means secured to said support ring for adjusting radial position of said bar-shaped magnet holders and an adjustment plate provided between said support ring and said magnet holder to adjust its axial position, and said magnet holder being of a magnetically non-conductive material.

6. A circular knitting machine as defined in claim 5 wherein each of said electromagnets includes a permanent magnet inserted between end portions of two parallel pole pieces of soft iron, said electromagnet and pole pieces being anchored in a support block of non-magnetic material which is attached to an end of said bar-shaped magnet support, the free ends of said pole pieces being connected to a slide bar of saphire having a raised end face for contacting said armature surface of the selecting jacks.

7. A circular knitting machine as defined in claim 5 wherein said adjusting means includes adjusting screws for adjusting the radial position of said magnet support and for tilting the same relative to said adjustment plate.

8. A circular knitting machine as defined in claim 6 wherein said guiding slots in the jacket of said needle cylinder are provided with web-shaped inserts whose lower end portions overlap the upper edge of said circumferential recess in the needle cylinder, said end portions of the webs being beveled radially inwardly to provide access of said armature surfaces of the selecting jacks toward said electromagnets.

9. A circular knitting machine as defined in claim 8 wherein said web-shaped inserts in the guiding slots are each provided with a recess for receiving said lower pressing cam.

10. A circular knitting machine as defined in claim 9 wherein said jack cam race is provided with an inner circumferential groove for accommodating a retaining ring for the selecting jacks.

* * * * *